US010132023B2

(12) United States Patent
Doyle et al.

(10) Patent No.: US 10,132,023 B2
(45) **Date of Patent: *Nov. 20, 2018**

(54) HOUSEHOLD CLEANING APPLIANCE WITH A DISPENSING SYSTEM OPERABLE BETWEEN A SINGLE USE DISPENSING SYSTEM AND A BULK DISPENSING SYSTEM

(71) Applicant: WHIRLPOOL CORPORATION, Benton Harbor, MI (US)

(72) Inventors: Colleen M. Doyle, Ann Arbor, MI (US); Michael S. Hendrickson, Owasso, MI (US); Joel A. Luckman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 68 days.

This patent is subject to a terminal disclaimer.

(21) Appl. No.: 15/137,475

(22) Filed: Apr. 25, 2016

(65) Prior Publication Data

US 2016/0237611 A1 Aug. 18, 2016

Related U.S. Application Data

(60) Continuation of application No. 14/186,326, filed on Feb. 21, 2014, now Pat. No. 9,481,959, which is a (Continued)

(51) Int. Cl.
*D06F 39/02* (2006.01)
*D06F 33/02* (2006.01)
(Continued)

(52) U.S. Cl.
CPC ..... *D06F 39/022* (2013.01); *D06F 33/02* (2013.01); *D06F 35/005* (2013.01);
(Continued)

(58) Field of Classification Search
CPC ..... D06F 33/02; D06F 39/02; D06F 39/022; D06F 39/028; D06F 2202/02; D06F 2204/02
See application file for complete search history.

(56) References Cited

U.S. PATENT DOCUMENTS 2,816,427 A 12/1957 Vela
2,872,076 A 2/1959 Bloom
(Continued)

FOREIGN PATENT DOCUMENTS

CA 2027154 A1 4/1991
DE 8033429 U1 5/1982
(Continued)

OTHER PUBLICATIONS

German Search Report for Counterpart DE102009030288, dated Feb. 27, 2012.
(Continued)

*Primary Examiner* — Joseph L. Perrin

(57) ABSTRACT

In a household cleaning appliance configured to execute a cleaning cycle on an article, having a non-bulk dispensing system that stores a single dose of treating chemistry that the dispensing system dispenses to the treating chamber in total as part of the execution of the cleaning cycle, the method includes adding bulk dispensing functionality to the non-bulk dispensing system for operating the dispensing system as a bulk dispensing system.

19 Claims, 5 Drawing Sheets

Related U.S. Application Data continuation of application No. 13/472,845, filed on May 16, 2012, now Pat. No. 8,677,538, which is a division of application No. 12/165,712, filed on Jul. 1, 2008, now Pat. No. 8,196,441.

(51) Int. Cl.
*D06F 35/00* (2006.01)
*D06F 39/00* (2006.01)

(52) U.S. Cl.
CPC ..... *D06F 39/005* (2013.01); *D06F 39/02* (2013.01); *D06F 39/026* (2013.01); *D06F 39/028* (2013.01); *D06F 2202/02* (2013.01); *D06F 2204/02* (2013.01)

(56) References Cited

U.S. PATENT DOCUMENTS 3,120,329 A 2/1964 Noakes
3,736,773 A 6/1973 Waugh
3,826,408 A 7/1974 Berndt et al.
3,848,436 A 11/1974 Rottering
3,848,437 A 11/1974 Rottering
3,850,185 A 11/1974 Guth
3,881,328 A 5/1975 Kleimola et al.
3,990,272 A 11/1976 Gakhar
4,009,598 A 3/1977 Bernard et al.
4,103,520 A 8/1978 Jarvis et al.
4,162,028 A 7/1979 Reichenberger
4,426,362 A 1/1984 Copeland et al.
4,569,781 A 2/1986 Fernholz et al.
4,580,721 A 4/1986 Coffee et al.
4,763,493 A 8/1988 Nishite et al.
4,763,494 A 8/1988 der Kinderen
4,790,981 A 12/1988 Mayer et al.
4,845,965 A 7/1989 Copeland et al.
4,862,711 A 9/1989 Ikeda et al.
4,875,607 A 10/1989 Torita et al.
5,014,211 A 5/1991 Turner et al.
5,063,757 A 11/1991 Ikeda et al.
5,088,621 A 2/1992 Thompson et al.
5,134,867 A 8/1992 Kiuchi et al.
5,186,912 A 2/1993 Steindorf et al.
5,195,338 A 3/1993 Russo
5,207,080 A 5/1993 Reinhard
5,234,615 A 8/1993 Gladfelter et al.
5,261,432 A 11/1993 Sandrin
5,316,688 A 5/1994 Gladfelter et al.
5,390,385 A 2/1995 Beldham
5,392,827 A 2/1995 Yasso et al.
5,417,233 A 5/1995 Thomas et al.
5,435,157 A 7/1995 Laughlin
5,606,877 A 3/1997 Hashimoto
5,636,763 A 6/1997 Furness
5,743,115 A 4/1998 Hashimoto
5,758,521 A 6/1998 Roberts
5,836,482 A 11/1998 Ophardt et al.
5,839,097 A 11/1998 Klausner
5,870,906 A 2/1999 Denisar
5,897,671 A 4/1999 Newman et al.
5,913,454 A 6/1999 McHale
5,992,685 A 11/1999 Credle, Jr.
6,007,788 A 12/1999 Bellon et al.
6,169,964 B1 1/2001 Aisa et al.
6,227,012 B1 5/2001 Borroni et al.
6,349,440 B1 2/2002 Amberg et al.
6,401,499 B1 6/2002 Clark et al.
6,434,977 B1 8/2002 Hapke et al.
6,918,398 B2 7/2005 Edelmann et al.
6,995,129 B2 2/2006 Olson et al.
6,998,380 B2 2/2006 Fry et al.
7,036,175 B2 5/2006 Sears et al.
7,047,663 B2 5/2006 Zhang et al.
7,059,065 B2 6/2006 Gerlach et al.
7,066,412 B2 6/2006 Conley et al.
7,177,712 B2 2/2007 Blair et al.
7,250,086 B2 7/2007 Furber et al.
7,275,552 B2 10/2007 DeWeerd et al.
7,424,813 B2 9/2008 Wu
7,464,718 B2 12/2008 McIntyre et al.
7,578,150 B2 8/2009 Zsambeki
7,658,088 B2 2/2010 Walker et al.
7,725,970 B2 6/2010 Tuttle et al.
7,950,088 B2 5/2011 Dalton et al.
8,052,805 B2 11/2011 Hendrickson et al.
8,122,743 B2 2/2012 Schulze
8,196,441 B2 6/2012 Hendrickson et al.
8,246,756 B2 8/2012 Hendrickson et al.
8,382,913 B2 2/2013 Classen et al.
8,397,544 B2 3/2013 Hendrickson
8,438,881 B2 5/2013 Ihne et al.
8,468,858 B2 6/2013 Hendrickson et al.
8,505,341 B2 8/2013 Hendrickson et al.
8,677,538 B2 3/2014 Hendrickson et al.
8,713,737 B2 5/2014 Ihne et al.
8,789,226 B2 7/2014 Dalton et al.
9,074,312 B2 7/2015 D'Andrea et al.
2001/0049846 A1 12/2001 Guzzi et al.
2002/0040505 A1 4/2002 Tanaka et al.
2002/0040506 A1 4/2002 Seagar et al.
2002/0088502 A1 7/2002 Van Rompouy
2003/0009428 A1 1/2003 Bathe
2003/0010791 A1 1/2003 Gentiluomo et al.
2003/0051513 A1 3/2003 Castelli et al.
2003/0116177 A1 6/2003 Appel et al.
2003/0154560 A1 8/2003 Behrens et al.
2003/0213503 A1 11/2003 Price et al.
2003/0233168 A1 12/2003 Perin, Jr. et al.
2003/0233710 A1 12/2003 Classen
2004/0005990 A1 1/2004 Aubay et al.
2004/0010859 A1 1/2004 Aubay et al.
2004/0082491 A1 4/2004 Olson et al.
2004/0084065 A1 5/2004 Edelmann et al.
2004/0098811 A1 5/2004 Tuttle et al.
2004/0244434 A1 12/2004 Zucholl et al.
2004/0244819 A1 12/2004 Edelmann et al.
2005/0121058 A1 6/2005 Furber et al.
2005/0126608 A1 6/2005 DeWeerd et al.
2005/0229652 A1 10/2005 Kim et al.
2006/0040845 A1 2/2006 Gladfelter et al.
2006/0107705 A1 5/2006 Hsu et al.
2006/0117811 A1 6/2006 Kinnetz
2006/0150437 A1 7/2006 Tarnowski et al.
2006/0196529 A1 9/2006 Kenowski et al.
2006/0254626 A1 11/2006 Botts et al.
2006/0270579 A1 11/2006 Aubay et al.
2006/0272359 A1 12/2006 Kang
2006/0272360 A1 12/2006 Hsu et al.
2007/0022790 A1 2/2007 Slutsky et al.
2007/0084253 A1 4/2007 Ehrlich et al.
2007/0131000 A1 6/2007 Jeong
2007/0163098 A1 7/2007 Tomasi et al.
2007/0163307 A1 7/2007 Kramme et al.
2007/0261177 A1 11/2007 Risen et al.
2008/0107576 A1 5/2008 Zettlitzer et al.
2008/0276966 A1 11/2008 Yusuf et al.
2009/0095028 A1 4/2009 Hoppe et al.
2009/0095031 A1 4/2009 Favaro et al.
2009/0100880 A1 4/2009 Hill
2009/0100881 A1 4/2009 Dahlke
2009/0158782 A1 6/2009 Hill
2009/0235962 A1 9/2009 Classen et al.
2009/0293202 A1 12/2009 Bolduan et al.
2009/0308111 A1 12/2009 Robb et al.
2010/0000264 A1 1/2010 Luckman et al.
2010/0000580 A1 1/2010 Classen et al.
2010/0040213 A1 2/2010 Park et al.
2010/0115708 A1 5/2010 Caswell et al.

(56) References Cited

U.S. PATENT DOCUMENTS

| | | | |
|---|---|---|---|
| 2010/0300157 | A1 | 12/2010 | Schulze |
| 2011/0017239 | A1 | 1/2011 | VanLoyen et al. |

FOREIGN PATENT DOCUMENTS

| | | | |
|---|---|---|---|
| DE | 3403622 | A1 | 8/1985 |
| DE | 3403852 | A1 | 8/1985 |
| DE | 3833961 | A1 | 4/1990 |
| DE | 3908438 | A1 | 9/1990 |
| DE | 4014776 | A1 | 11/1991 |
| DE | 4017001 | A1 | 11/1991 |
| DE | 69019666 | T2 | 10/1995 |
| DE | 19619602 | A1 | 11/1997 |
| DE | 19902974 | A1 | 10/1999 |
| DE | 20115173 | U1 | 11/2001 |
| DE | 10144667 | A1 | 3/2003 |
| DE | 10334283 | A1 | 12/2004 |
| DE | 102006043913 | A1 | 3/2008 |
| DE | 102007023065 | A1 | 11/2008 |
| DE | 102009030288 | A1 | 1/2010 |
| DE | 102009030290 | A1 | 1/2010 |
| DE | 102009030329 | A1 | 1/2010 |
| EP | 0169604 | A2 | 1/1986 |
| EP | 423044 | A1 | 4/1991 |
| EP | 0611159 | A1 | 8/1994 |
| EP | 0685587 | A1 | 12/1995 |
| EP | 1063340 | A1 | 12/2000 |
| EP | 1637060 | A2 | 3/2006 |
| EP | 1731654 | A1 | 12/2006 |
| EP | 1808520 | A1 | 7/2007 |
| EP | 1842953 | A2 | 10/2007 |
| EP | 1849909 | A1 | 10/2007 |
| EP | 1884584 | A2 | 2/2008 |
| EP | 2003237 | A1 | 12/2008 |
| EP | 2141276 | A1 | 1/2010 |
| EP | 2324151 | B1 | 12/2011 |
| EP | 2518204 | A1 | 10/2012 |
| EP | 2342377 | B1 | 1/2015 |
| GB | 2015870 | A | 9/1979 |
| GB | 2134078 | A | 8/1984 |
| GB | 2136831 | A | 9/1984 |
| GB | 2214524 | A | 9/1989 |
| GB | 2311767 | A | 10/1997 |
| GB | 2386130 | A | 9/2003 |
| GB | 2417492 | A | 3/2006 |
| IT | TO20060569 | A1 | 2/2008 |
| JP | 03191994 | A | 8/1991 |
| JP | 11309296 | A | 11/1999 |
| WO | 8806199 | A1 | 8/1988 |
| WO | 0220893 | A1 | 3/2002 |
| WO | 02058528 | A1 | 8/2002 |
| WO | 2003027377 | A1 | 4/2003 |
| WO | 03102291 | A1 | 12/2003 |
| WO | 2006010924 | A1 | 2/2006 |
| WO | 2006021760 | A1 | 3/2006 |
| WO | 2006037354 | A1 | 4/2006 |
| WO | 2006042631 | A1 | 4/2006 |
| WO | 2006061041 | A1 | 6/2006 |
| WO | 2006094219 | A1 | 9/2006 |
| WO | 2006098571 | A1 | 9/2006 |
| WO | 2007056097 | A2 | 5/2007 |
| WO | 2008034691 | A1 | 3/2008 |
| WO | 2008034965 | A1 | 3/2008 |
| WO | 2008053183 | A1 | 5/2008 |
| WO | 2008138798 | A2 | 11/2008 |
| WO | 2008155264 | A1 | 12/2008 |
| WO | 10010433 | A2 | 1/2010 |

OTHER PUBLICATIONS

German Search Report for Counterpart DE102009030289, dated Feb. 11, 2014.

German Search Report for Counterpart DE102009030329, dated Feb. 7, 2014.

HOUSEHOLD CLEANING APPLIANCE WITH A DISPENSING SYSTEM OPERABLE BETWEEN A SINGLE USE DISPENSING SYSTEM AND A BULK DISPENSING SYSTEM

CROSS REFERENCE TO RELATED APPLICATIONS

This application is a continuation of U.S. patent application Ser. No. 14/186,326, filed Feb. 21, 2014, now U.S. Pat. No. 9,481,959, issued Nov. 1, 2016, which is a continuation of U.S. patent application Ser. No. 13/472,845, filed May 16, 2012, now U.S. Pat. No. 8,677,538, issued Mar. 25, 2014, which is a division of U.S. patent application Ser. No. 12/165,712, filed Jul. 1, 2008, now U.S. Pat. No. 8,196,441, issued Jun. 12, 2012, all of which are hereby incorporated by reference in their entirety.

BACKGROUND OF THE INVENTION

Contemporary cleaning appliances, such as dishwashers or clothes washers, may be a common convenience in many homes. In the case of a clothes washer, a user simply loads the cleaning appliance with laundry to be treated into a treating chamber, along with an optional supply of a treating chemistry, such as detergents, bleach, enzymes, and anti-spotting agents, and selects and initiates a cleaning cycle that may be subsequently automatically carried out by the cleaning appliance. An example of a typical cleaning cycle includes the steps of washing the laundry with heated liquid and optional treating chemistry and rinsing the laundry with heated liquid.

Cleaning appliances may be often provided with a dispenser for automatically dispensing one or more treating chemistries during a cleaning cycle. One common type of dispenser may be the manual or single use dispenser, which may be filled with only enough treating chemistry for a single cleaning cycle. These manual dispensers must be filled with treating chemistry by a user prior to each cleaning cycle of the cleaning appliance, which may be a tedious task that many users would prefer not to perform. Also, users may not supply the correct dosage of the treating chemistries for the selected cleaning cycle, which may negatively impact the efficacy of the cleaning cycle.

Bulk dispensing may be one solution that improves the ease of supplying treating chemistry in the proper dosage to the cleaning appliance for the user. However, many users are unwilling to purchase a new machine just for a bulk dispensing system.

SUMMARY OF THE INVENTION

The invention relates to an apparatus for adding bulk dispensing functionality to a non-bulk dispensing system in a household cleaning appliance.

DESCRIPTION OF EMBODIMENTS OF THE INVENTION

Figure 1:
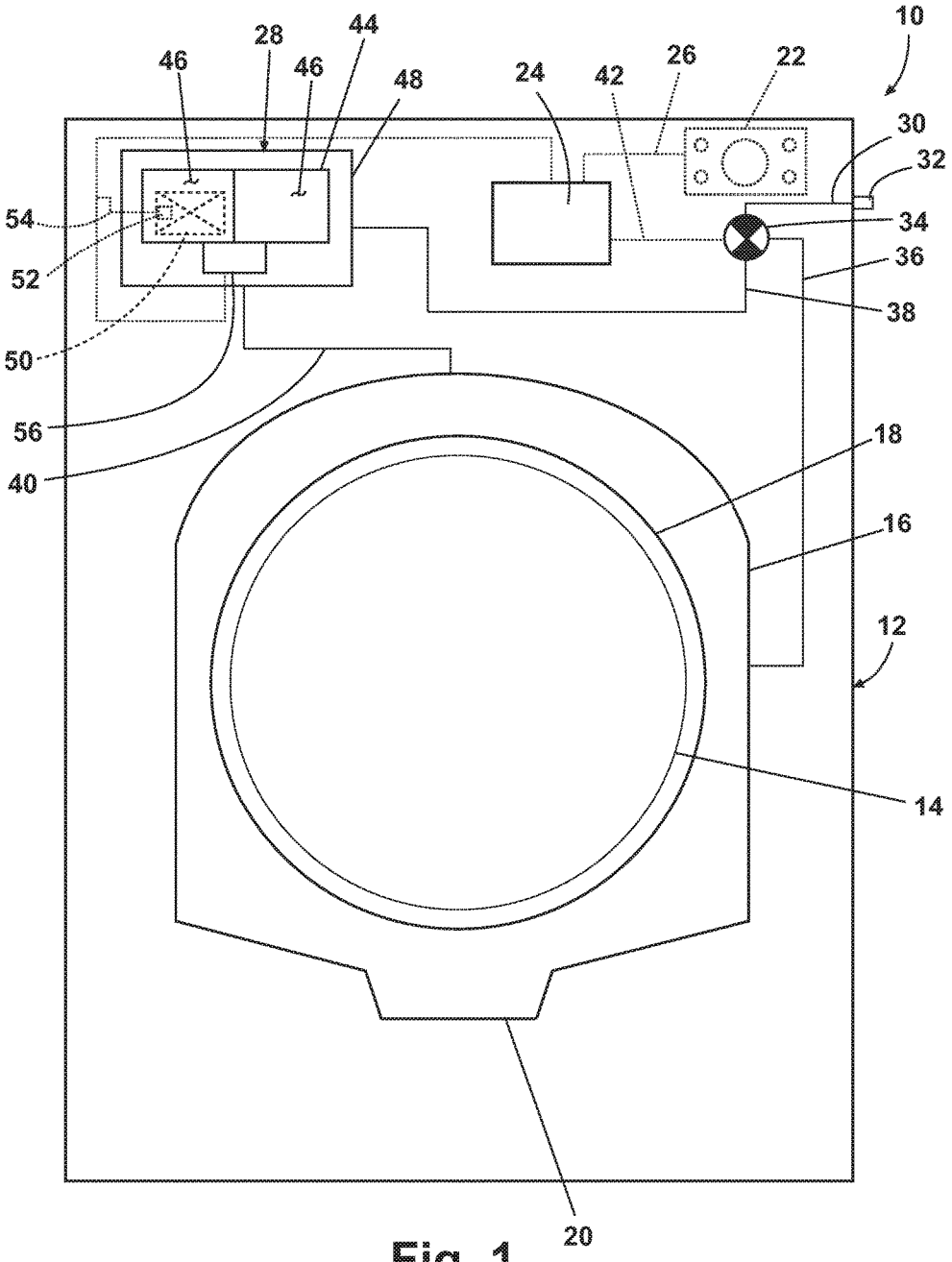
FIG. 1 is a schematic view of an automatic clothes washing machine having a dispensing system according to one embodiment of the invention.

Referring now to FIG. 1, a first embodiment of the invention may be illustrated as a cleaning appliance in the environment of a horizontal axis automatic clothes washing machine 10. Although much of the remainder of this application will focus on the embodiment of an automatic clothes washing machine, the invention may have utility in other environments, including other cleaning appliances, such as dishwashers. The automatic clothes washing machine 10 shares many features of a conventional automated clothes washer, which will not be described in detail herein except as necessary for a complete understanding of the invention. The invention may also be utilized in other fabric treatment appliances such as a dryer, such as a tumble dryer or a stationary dryer, or a combination washing machine and dryer.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. In horizontal axis machines mechanical energy is typically imparted to the clothes by the tumbling action formed by the repeated lifting and dropping of the clothes, which is typically implemented by the rotating drum. The invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 enclosing components typically found in a conventional washing machine, such as motors, pumps, fluid lines, controls, sensors, transducers, and the like. A door 14 (shown in phantom) may be mounted to the cabinet to selectively close an access opening to the interior of an imperforated drum 16 that defines a treating chamber in which laundry may be treated. Both the drum 16 and a perforated basket 18 may be located within the interior of the cabinet 12. The drum 16 may be associated with a sump 20 for temporarily storing or collecting a liquid used during a cleaning cycle. The sump may normally be connected to a drain (not shown) to provide a flow path for removing the liquids.

While the drum 16 may have been described as defining the treating chamber, with the basket 18 located within the drum 16, and thereby located within the treating chamber, it may be that just the basket need be considered the treating chamber as the laundry may be typically retained within the basket and the treating chemistry may be directly into the basket or indirectly through the drum 16.

While not shown, some clothes washers include a recirculation system for recirculation of liquid from the sump to the laundry in the basket 18. The recirculating spray may be used in combination with rotating the drum 16 to draw the sprayed liquid through the laundry using centrifugal force. Alternatively, or in combination with the recirculation system, the liquid may be raised to a level within the drum 16 where a portion of the basket 18 is submerged. The rotation of the basket 18 causes the laundry to tumble in the liquid. Either of the recirculation or tumble methods of cleaning may be used with the current invention.

The cabinet 12 may include a user interface 22 that may have operational controls such as dials, lights, switches, and displays enabling a user to input commands to a controller 24 and receive information, such as cycle selection, cycle parameters, and cycle options. The user interface 22 may be electrically coupled with the controller 24 through a user interface lead 26.

The cabinet 12 may also include a dispensing system 28 for dispensing treating chemistry during a cleaning cycle. In this embodiment the treating chemistry may be any type of aid for treating fabric, and examples may include, but are not limited to washing aids, such as detergents and oxidizers, including bleaches, and additives, such as fabric softeners, sanitizers, de-wrinklers, and chemicals for imparting desired properties to the fabric, including for example, stain resistance, water repellency, fragrance (e.g., perfumes), insect repellency, brighteners, whitening agents, builders, and UV protection.

The cabinet 12 may also include a conduit 30 fluidly coupled with a water supply 32, and a valve 34. The water supply 32 may be fluidly coupled through conduit 30 through a valve 34 with a dispensing line 36 and a dispensing line 38. Dispensing line 36 fluidly couples directly to the drum 16, whereas dispensing line 38 fluidly couples to the dispensing system 28. Thus, the valve 34 may be used to control the supply of water directly to the drum 16 and/or the dispensing system 28. In other embodiments of the invention, dispensing line 36 could be omitted.

A dispensing line 40 fluidly couples the dispensing system 28 with the drum 16. Thus, fresh water may be delivered from the water supply 32 through the conduit 30, valve 34 and dispensing line 38 into the dispensing system 28 for flushing treating chemistry from the dispensing system 28 through the dispensing line 40 into the drum 16. The valve 34 may be electrically coupled with the controller 24 through a valve control lead 42. The controller 24 may control the operation of the valve 34 in response to instructions received from the user interface 22 as a result of selections made by the user, such as cleaning cycle, water temperature, spin speed, extra rinse, and the like.

The dispensing system 28 may include at least one dispensing chamber 46 that stores a single dose of treating chemistry that the dispensing system 28 dispenses to the treating chamber and/or the drum 16, as part of the execution of the cleaning cycle. The dispensing system 28 may be illustrated as including multiple dispensing chambers 46.

As used herein, the term "single dose of treating chemistry", and variations thereof, refers to an amount of treating chemistry sufficient for one cleaning cycle of the automatic clothes washing machine 10 and the term "multiple doses of treating chemistry", and variations thereof, refers to an amount of treating chemistry sufficient for multiple cleaning cycles of the automatic clothes washing machine 10. The term "cleaning cycle" may be used to mean one operational cycle of the automatic clothes washing machine 10 that cleans a load of laundry. The dispensing system 28 with dispensing chamber 46 as described thus far represents a non-bulk dispensing system or a manual dispenser.

Further, the dispensing system 28 may include a dispenser cup 44 that defines the at least one dispensing chamber 46. The dispenser cup 44 may, for example, be fixed to the cabinet or slidable relative to the cabinet. In either case the dispenser cup 44 will be accessible either through the cabinet 12 or exteriorly of the cabinet 12 for refilling purposes. The dispensing system 28 may also include a dispenser housing 48 located within the cabinet 12 and underlying the dispenser cup 44 when the dispenser cup 44 may be filled and ready for dispensing. The dispenser cup 44 and the dispensing chamber 46 fluidly couple the dispenser housing 48 such that when the dispenser cup 44 or dispensing chamber 46 may be flushed with water from the supply 30, the resulting mixture of water and chemistry may be directed to the housing 48, where the mixture flows into the drum 16 through conduit 40.

The flushing of the chemistry from the dispenser cup 44 may be accomplished in any suitable manner. For example, a siphon line (not shown) may be provided and fluidly coupled to the dispenser housing 48 such that as the water from the supply 30 rises to an inlet to the siphon line, the mixture in the dispenser cup 44 may be siphoned out of the dispenser cup 44 and into the housing 48. Another exemplary technique includes overflowing the dispensing cup 44 with water, such that the mixture overflows from the dispenser cup 44 and into the dispenser housing 48.

The dispenser cups 44 are a single-use type dispensing system. To provide bulk dispensing functionality to this type of dispensing system, a bulk dispensing cartridge 50 may be received in the dispensing chamber 46 and may fluidly couple the dispensing chamber 46 to the housing 48 and/or the dispensing line 40.

Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

The bulk dispensing cartridge 50 may include an indicator 52 (shown in phantom) indicating the amount of treating chemistry in the bulk dispensing cartridge 50. The indicator 52 may be any suitable type of indicator, such as a float indicator, for indicating the amount of treating chemistry in the bulk dispensing cartridge 50. The indicator 52 may also be a sensor that senses the amount of treating chemistry and/or the presence or absence of treating chemistry. Further, the indicator 52 may sense the presence of the bulk dispensing cartridge 50 in general. Regardless of the type, the indicator 52 may send a signal to the controller 24 through the lead 54 to indicate the amount of the treating chemistry or the presence of treating chemistry in the bulk dispensing cartridge 50. The foregoing description may be of an exemplary indicator location. Other locations may be utilized for the indicator 52, for example, such as being incorporated into the treating chemistry meter 56, into the dispensing line 40, into a part of the dispenser cup 44, or into a part of the dispenser housing 48.

The cabinet 12 may include a treating chemistry meter 56 operably coupled to the bulk dispensing cartridge 50 to control the dosing of the treating chemistry from the bulk dispensing cartridge 50 to the dispensing system 28 or a conduit that may be formed by the dispenser housing 48 and the dispensing line 40 which in turn fluidly couples the drum 16. The treating chemistry meter 56 may be a pump, a valve, a flow meter, or any other suitable metering device fluidly coupling the bulk dispensing cartridge 50 to the dispensing system 28. More specifically the bulk dispensing cartridge 50 may be fluidly coupled to the dispenser housing 48, the dispenser cup 44, or another dispensing chamber 46 through the treating chemistry meter 56 when the dispenser cup 44 may be in the closed position. The dispensing system 28 and treating chemistry meter 56 may be operably coupled with the controller 24 such that the controller 24 may implement the cleaning cycle by controlling the operation of the treating chemistry meter 56 to control the dosing of the treating chemistry from the bulk dispensing cartridge 50 to the dispensing system 28.

The treating chemistry meter 56 may dose treating chemistry into the drum 16 multiple times during a single cleaning cycle. Dosing of the treating chemistry does not need to be done all at one time. For example, smaller amounts of treating chemistry, equal to a full single dose, may be dispensed by the treating chemistry meter 56 at separate times throughout the cleaning cycle. Further, multiple full doses may be dispensed during the cleaning cycle.

The automatic clothes washing machine 10 illustrated in FIG. 1 is only one example of a washing machine configuration. It will be recognized that a fewer or greater number of conduits as well as pumps may be utilized for selected functions, a fewer or greater number of valves may be utilized depending upon the selected fluid line configuration and degree of control desired, and control leads may be incorporated into the device based upon the components for which control by the controller 24 may be desired.

Figure 2:
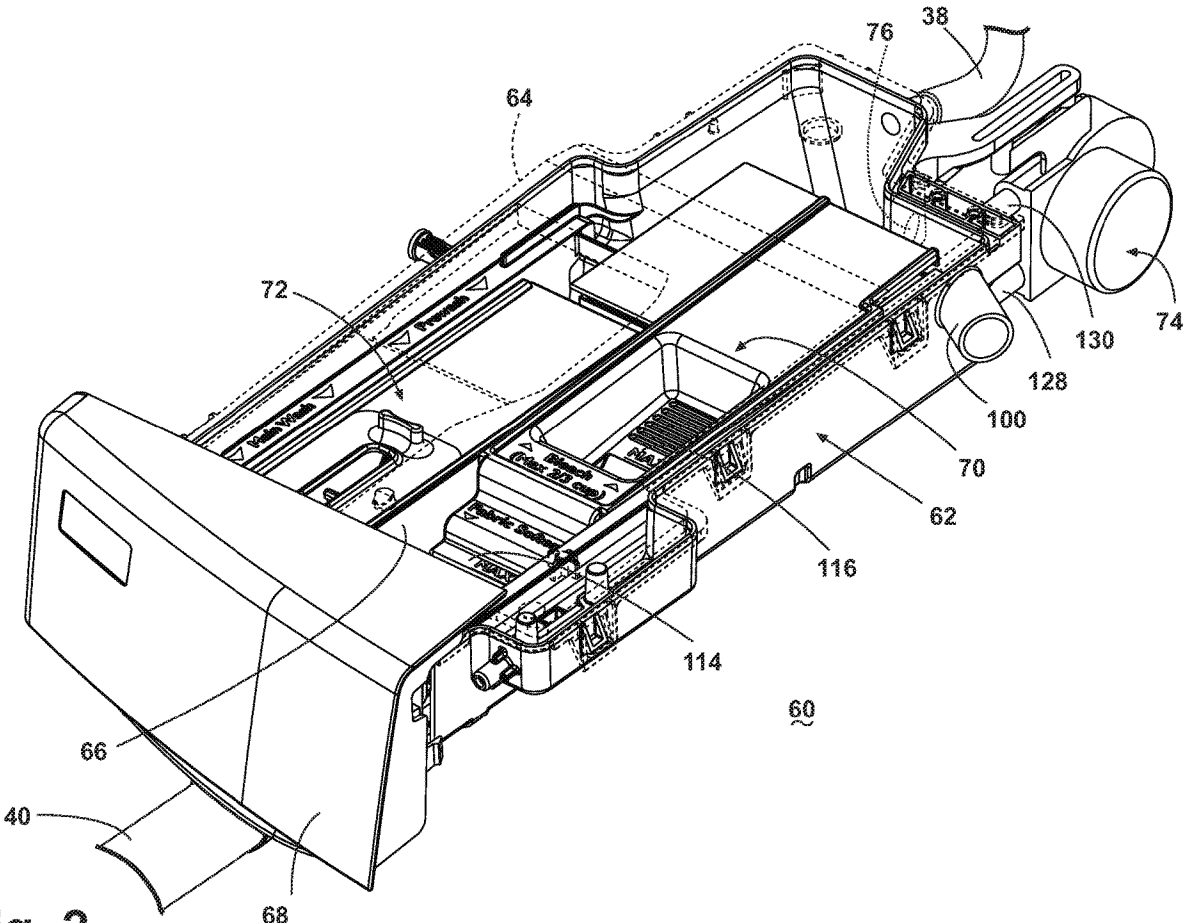
FIG. 2 is a perspective view of an exemplary dispensing system with a bulk cartridge fully received within a dispensing chamber according to one embodiment of the invention.

FIG. 2 illustrates a specific implementation adding bulk dispensing functionality to a single use dispensing system according to one embodiment of the invention. In general, the bulk dispensing system 60 may be a drawer-type, single-use dispensing system having multiple dispenser cups with bulk dispensing functionality added to the single-use dispensing system by the addition of a bulk dispensing cartridge and a metering device. In other embodiments the bulk dispensing system 60 may be fixed within the cabinet 12 (not shown in FIG. 2) and have a moveable door, hatch, access panel, or other access mechanism for access to it.

More specifically, the bulk dispensing system 60 shown includes a lower dispenser housing 62, an upper dispenser housing 64 (shown in phantom), a dispenser drawer 66, a dispenser drawer handle 68, a cup cover 70, a bulk dispensing cartridge 72 configured to store multiple doses of a treating chemistry, and a bulk dispenser pump 74. The bulk dispensing system 60 may be unique in that the dispensing dispenser drawer 66 may be a manual dispenser that may receive the bulk dispensing cartridge 72 to add bulk dispensing functionality to a single use dispensing system.

The lower dispenser housing 62 may be located within the cabinet 12 and underlying the dispenser drawer 66 when the dispenser drawer 66 sits in a closed position as illustrated in FIG. 2. The lower dispenser housing 62 may carry the treating chemistry meter, depicted in FIG. 2 as bulk dispenser pump 74, such that when the dispenser drawer 66 is in the closed position the bulk dispensing cartridge 72 fluidly couples the lower dispenser housing 62 through the bulk dispenser pump 74 and through a lower dispenser housing second port 76 (shown in phantom). Thus, when the dispenser drawer 66 is in the closed position the bulk dispenser pump 74 may draw treating chemistry from the bulk dispensing cartridge 72 and dispense it to the lower dispenser housing 62.

The upper dispenser housing 64 may be located within the cabinet 12 and overlying the dispenser drawer 66 when the dispenser drawer 66 sits in a closed position. The water supply 32 may be fluidly coupled to either of the dispenser drawer 66 or the lower dispenser housing 62 via the upper dispenser housing 64, a water diverter 80 (FIG. 3), the conduit 30 (FIG. 1) and the valve 34 (FIG. 1), which may be operably controlled by the controller 24. Further, either of the dispenser drawer 66 or the lower dispenser housing 62 may be fluidly coupled to the drum 16 (FIG. 1) via the lower dispenser housing 62 and the dispensing line 40. With this configuration, water may be provided from the supply to either of the lower dispenser housing 62 or the dispenser drawer 66 to flush a treating chemistry to the treating chamber through the dispensing line 40. In this way, the lower dispenser housing 62 and the dispensing line 40 may be described as forming a conduit to the treating chamber.

The structure of the bulk dispenser 60 will be described in greater detail with regard to FIG. 3, which illustrates an exploded view of the bulk dispensing system 60 of FIG. 2. Beginning with the details of the lower dispenser housing 62, it may be seen that the lower dispenser housing 62 may have a sloped back wall 90 and a sloped bottom wall 92, and that an outlet port 94 may be located at the front of the sloped bottom wall 92. The outlet port 94 fluidly couples the drum 16 through the dispensing line 40. The lower dispenser housing 62 also may have several other ports 96, 98, 100 of which, only port 96 may be relevant to the invention according to the embodiment shown. Port 96 may be fluidly coupled by dispensing line 38 and valve 34 to the water supply 32.

The dispenser drawer 66 defines at least one dispensing chamber 46 fluidly coupled to the treating chamber and used as a treating chemistry compartment to store a single dose of liquid treating chemistry to be dispensed by the dispensing system as part of the execution of a cleaning cycle of the automatic washing machine 10. The dispenser drawer may be illustrated as including multiple dispensing chambers 106, 108, 110 that act as treating chemistry reservoirs or compartments that may hold liquid or powdered treating chemistry, such as laundry detergent, fabric softener, bleach, and the like. The dispenser drawer 66 fluidly couples to the lower dispenser housing 62 such that when any of the dispensing chambers 106, 108, and 110 are flushed with water from the supply 32, the resulting mixture of water and chemistry may be dispensed to the lower dispensing housing 62, where it may be carried by dispensing line 40 to the drum 16.

Looking at the upper dispenser housing 64, the upper dispenser housing 64 may be formed such that water paths 102 may be located in its interior. Water entering the port 96 may be supplied to the water diverter 80 and may be directed through a water diverter outlet 104 into one of several different water paths 102, formed internally in the upper dispenser housing 64, to various portions of the lower dispenser housing 62 and to various portions of the dispenser drawer 66. The water may then flush any treating chemistry therein to form a mixture, which may then travel through the outlet port 94 in the lower dispenser housing 62, through the dispensing line 40, and into the drum 16.

The water diverter 80, and thus the water diverter outlet 104, may be operably coupled with the controller 24. Thus, the water diverter 80, operated by the controller 24, may operate to selectively control the fluid coupling of the water diverter outlet 104 with different water paths 102. The water diverter 80, operated by the controller 24, may divert a flow of water through one of the different water paths 102 to the dispensing chamber 46 in the absence of the bulk dispensing cartridge 72 and through another of the different water paths 102 to the lower dispenser housing 62 in the presence of the bulk dispensing cartridge 72.

In the embodiment shown, the cup cover 70 when inserted into the dispenser drawer 66 overlies a portion of the dispenser drawer 66 and more specifically overlies at least a portion of dispensing chambers 106, 108. The cup cover 70 hides siphon posts 112, 113, which are fluidly coupled to the lower dispenser housing 62. When the chambers 106, 108 are flushed with water, the mixture of water and chemistry will be siphoned into the lower dispensing housing 62 through the siphon posts 112, 113.

The dispenser drawer 66 may be slideably mounted to the lower dispenser housing 62 for slidable movement between an opened position (FIG. 4), where the at least one dispensing chamber may be accessible exteriorly of the cabinet 12, and a closed position (FIG. 2), where the at least one dispensing chamber may be within the cabinet 12. The dispenser drawer handle 68 may be used to effect the movement of the dispenser drawer 66.

To add bulk dispensing functionality to the single use dispenser, the bulk dispenser cartridge 72 may be removeably received in one of the dispensing chambers, such as dispensing chamber 110. The bulk dispenser cartridge 72 contains a quantity of a treating chemistry, such as a laundry detergent, stored therein and sufficient for several wash cycles. The bulk dispensing cartridge 72 may store multiple doses of treating chemistry because the treating chemistry it stores may be of a higher concentration than normally required for a single use dispensing cup and/or it may be of larger volume than the portion of the dispensing cup used to hold treating chemistry.

The bulk dispenser cartridge 72 may be illustrated as a generally rectilinear, box-like container defining a cartridge cavity in which the treating chemistry may be contained, although other shapes may also be possible. The cartridge cavity may be accessible through an opening selectively closed by a closing element 120, such as a slidable door, operable between an opened and closed position through which the bulk dispenser cartridge 72 may be filled when the closing element is in the opened position.

It should be noted that while the bulk dispensing cartridge 72 may be configured to fit in any of the chamber 106, 108, and 110, the bulk dispensing cartridge 72 may be sized to fit in the largest of the chambers to maximize the holding capacity of the bulk dispensing cartridge. In most single use dispensing systems, the detergent chamber will be the largest chamber because most detergent chambers are sized to receive both liquid and powder detergents, with powder detergents requiring a larger volume for the same dosing. Typically, a moveable/removable dividing wall may be placed in the detergent chamber and may be moved/removed within/from the chamber to select between liquid or powder detergents. This wall may be removed to make the entire volume of the chamber usable by the bulk dispensing cartridge 72.

A bulk dispenser pump 74 may be provided and fluidly couples the bulk dispenser cartridge 72 to the lower dispenser housing 62. The bulk dispenser pump 74 may be mounted to the exterior of the lower dispenser housing 62. In this way, the dispenser pump 74 may pump chemistry from the bulk dispenser cartridge 72, into the lower dispenser housing 62, and the water diverter 80 will divert water into the housing to flush the chemistry to the treating chamber through the outlet port 94 and dispensing line 40.

Referring back to FIG. 3, to effect the coupling of the bulk dispenser 60 (not shown) with the dispenser pump 74, a coupler 122 may be provided within a port 124 of the bulk dispenser cartridge 72. When the dispenser drawer 66 lies in the closed position, port 98 may be received within the coupler 122 wherein the coupler 122 then fluidly couples the port 98 with the dispenser pump 74. The dispenser pump outlet 130 fluidly couples with a second port 76 in the lower dispenser housing 62. Thus the dispenser pump 74 may be controlled by the controller 24 to supply a treating chemistry from the bulk dispenser cartridge 72 to the conduit formed of the lower dispenser housing 62 and dispensing line 40, which may then go to the treating chamber, such as the drum 16.

Alternatively, the bulk dispenser pump 74 may fluidly couple the bulk dispensing cartridge 72 to another of the dispensing chambers 106, 108. In this alternative embodiment the dispenser pump outlet 130 may be fluidly coupled through a port (not shown) in the dispenser drawer to another of the dispensing chambers 106, 108 such that when treating chemistry may be metered through the bulk dispenser pump 74 it may be deposited within another of the dispensing chambers 106, 108. In turn, water may be added until it may be reasonably certain that substantially all of the treating chemistry may be dispensed from the another of the dispensing chambers 106, 108. This may be referred to as flushing the another of the dispensing chambers 106, 108. Thus, the treating chemistry and liquid may flow through the dispensing line 40, which in turn fluidly couples to the drum 16.

Figure 3:
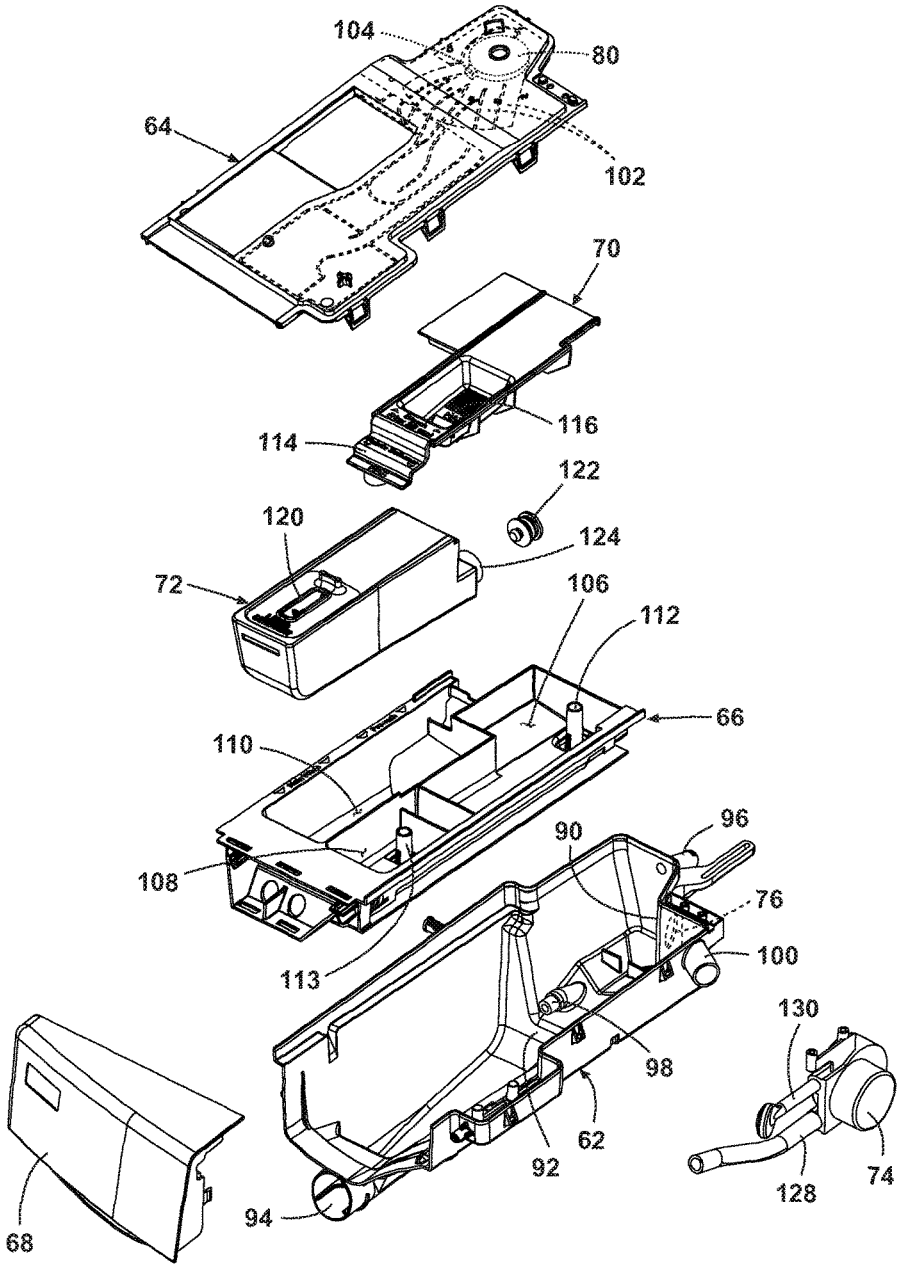
FIG. 3 is an exploded view of the bulk dispensing system illustrated in FIG. 2.
Figure 4:
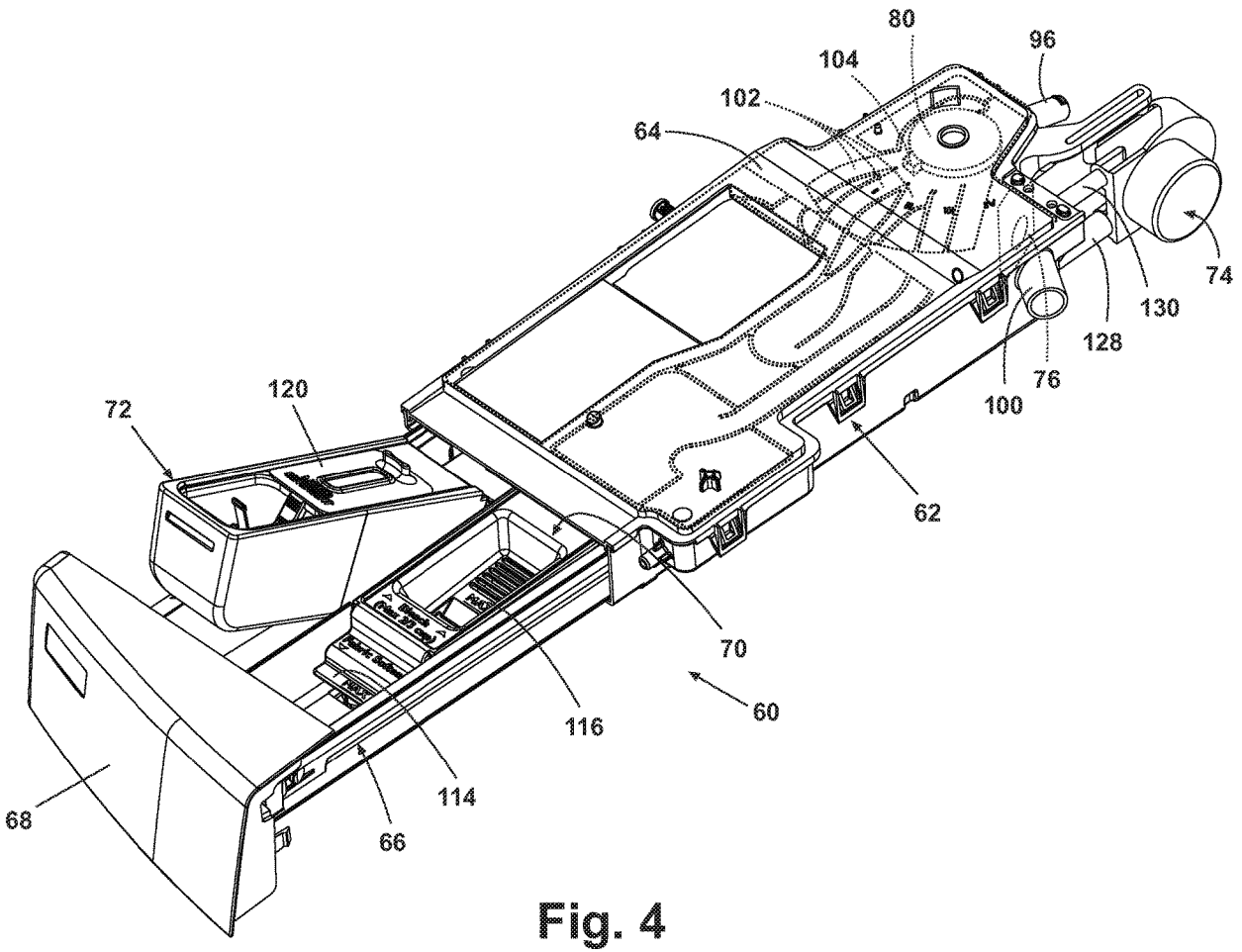
FIG. 4 is a second perspective view of the bulk dispensing system illustrated in FIGS. 2-3 with a bulk cartridge partially received within a dispensing chamber.

FIG. 4 illustrates the exemplary bulk dispensing system 60 of FIGS. 2-3 wherein the dispenser drawer 66 lies in the opened position and the bulk dispensing cartridge 72 rests partially installed in the dispensing chamber 110. After the bulk dispensing cartridge 72 is properly installed in the dispensing chamber 110, a selected volume of treating chemistry may be dispensed from the bulk dispensing cartridge 72 through operation of the bulk dispenser pump 74 under the control of the controller 24. Typically, this could be accomplished by a user selecting a cleaning cycle on the user interface 22, which would then be processed by the controller 24, along with a determination in a known manner of the size of the load, to automatically dispense the appropriate volume of treating chemistry. Alternatively, the user selecting a volume of treating chemistry on the user interface 22 would accomplish this, or a predetermined dosage could be dispensed.

A user may elect to dispense treating chemistry to the treating chamber 16 directly from any of the multiple dispensing chambers 106, 108, 110 by manually supplying a single dose of treating chemistry to any of the multiple dispensing chambers 106, 108, 110 from an external supply of treating chemistry. The user may also insert the bulk dispensing cartridge 72 into the dispensing chamber 110 to add bulk dispensing functionality to the otherwise non-bulk dispensing system. The user may selectively add this functionality whenever they have a notion to do so.

With the remaining dispensing chambers 106 and 108, and the removable bulk dispensing cartridge 72, the resulting bulk dispensing system 60 may be used as both a bulk dispensing system and a single use dispensing system. This may be done even when the bulk dispensing cartridge 72 may be present in the dispensing chamber 110 as the other dispensing chambers 106 and 108 are still usable as a single use dispensing system in their normal way.

After proper installation of the bulk dispensing cartridge 72 in the dispensing chamber 110 the bulk dispensing system 60 may be employed to dispense the treating chemistries contained therein into the drum 16 under the control of the controller 24. During operation of the automatic clothes washing machine 10, when the time comes to dispense the treating chemistry, the controller 24 signals the bulk dispenser pump 74 to supply a treating chemistry from the bulk dispensing cartridge 72 to the sloped back wall 90. The controller 24 then signals the valve 34 to allow water from the water supply 32 into port 96 of the lower dispenser housing 62 wherein the water may be directed downwards towards the treating chemistry located in the lower dispenser housing. Essentially, the automatic washing machine 10 effects a flushing of both the lower dispenser housing 62 and the conduit formed by the lower dispenser housing 62 and the dispensing line 40. The flushing of the lower dispenser housing 62 or conduit may also act to flush the bulk dispenser pump 74. The controller 24 may also introduce water from the water supply 32 into the dispenser drawer 66. This may act to flush both the dispenser drawer 66 and at least a portion of the lower dispenser housing 62, as they may be fluidly coupled together. Then, both the water and the treating chemistry travel down the sloped bottom wall 92, through the outlet port 94, through the dispensing line 40, and into the drum 16. After exiting the lower dispenser housing 62 through the outlet port 94 the treating chemistry may also go through any accompanying sprayers or conduits on its way to the drum 16.

The description thus far has disclosed a bulk dispensing that requires water to flush the chemistry to the drum 16. Alternatively, the bulk dispensing cartridge 50 may be located such that it may dispense chemistry directly to the drum 16. This eliminates the need for flushing.

Figure 5:
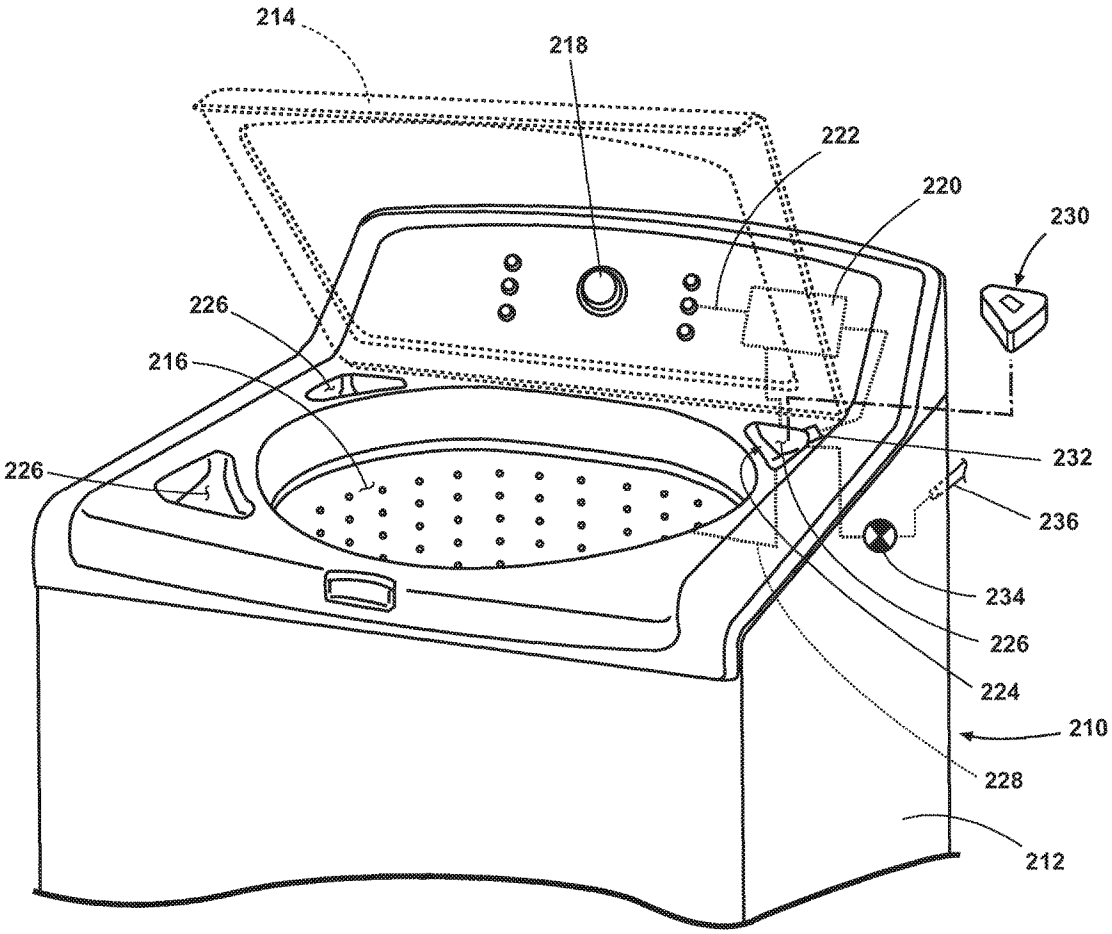
FIG. 5 is a schematic view of another embodiment of an automatic clothes washing machine having a dispensing system according to the invention.

Referring now to FIG. 5, another embodiment of the invention may be illustrated as a cleaning appliance in the environment of a vertical axis automatic clothes washing machine 210. The automatic clothes washing machine 210 may include a cabinet 212 enclosing components typically found in a conventional washing machine, such as motors, pumps, fluid lines, controls, sensors, transducers, and the like. A door 214 (shown in phantom) may be mounted to the cabinet 212 to selectively close an access opening to the interior of a known treating chamber 216 in which laundry may be treated. The cabinet 212 may include a user interface 218 that may have operational controls such as dials, lights, switches, and displays enabling a user to input commands to a controller 220 and receive information about a specific cleaning cycle. The user interface 218 may be electrically coupled with the controller 220 through user interface leads 222.

The cabinet 212 may also include a dispensing system for dispensing treating chemistry during a cleaning cycle. The dispensing system may include at least one dispensing chamber 226 configured to receive a single dose of treating chemistry that the dispensing system may dispense to the treating chamber 216 as part of the execution of the cleaning cycle. FIG. 5, actually illustrates multiple dispensing chambers 226 physically space from one another in the cabinet 212. It should be noted that, in addition to the general door 214 which covers the opening to the treating chamber 216 separate access panels could be used to cover each of the multiple dispensing chambers 226.

The dispensing chamber 226 may include a dispenser siphon pipe (not shown) or other mechanism to vacate chemistry from the dispensing chamber. In the case of a siphon pipe, to dispense the treating chemistry placed in the dispensing chamber 226, water may be added to the dispensing chamber 226 until the liquid may be above the pipe, at which point the liquid may be drawn by gravity into the pipe, which initiates a siphon process for removing the liquid from the dispensing chamber 226. Water may be added until it may be reasonably certain that substantially all of the treating chemistry may be dispensed from the dispensing chamber 226. While not shown in FIG. 5, the suction pipes may lead to a housing that may be fluidly connected to the dispensing line 228 such that the liquid exiting the suction pipe during flushing may be directed to the treating chamber 216. The at least one dispensing system 224 with dispensing chamber 226 as described thus far represents a non-bulk dispensing system or a manual dispenser.

The dispensing chamber 226 may be also configured to receive a bulk dispensing cartridge 230 configured to receive multiple doses of treating chemistry. When the bulk dispensing cartridge 230 may be received within the dispensing chamber 226, it may fluidly couple to the at least one dispensing system 224. When the bulk dispensing cartridge 230 may be received within the dispensing chamber 226, bulk dispensing functionality may be added to the non-bulk dispensing system. The bulk dispensing cartridge 230 may be fluidly coupled to the dispensing chamber 226 to deliver or dispense treating chemistry to the treating chamber 16 through the dispensing chamber 226.

The cabinet 212 may include a treating chemistry meter 232 operably coupled to the bulk dispensing cartridge 230 when it may be received within the dispensing chamber 226 to control the dosing of the treating chemistry from the bulk dispensing cartridge 230 to the dispensing system 224. The bulk dispensing cartridge 230 may also be fluidly coupled to the treating chamber 216 through the treating chemistry meter 232, such as a pump, for example. The dispensing system 224 and treating chemistry meter 232 may be operably coupled with the controller 220 such that the controller 220 may implement the cleaning cycle by controlling the operation of the treating chemistry meter 232 to control the dosing of the treating chemistry from the bulk dispensing cartridge 230 to the dispensing system 224 or to the treating chamber 216.

After proper installation of the bulk dispensing cartridge 230 in the dispensing chamber 226 the bulk dispensing system may be employed to dispense the treating chemistries contained therein into the drum 216 under the control of the controller 220. When the time comes to dispense the treating chemistry, the controller 220 signals the treating chemistry meter 232 to supply a treating chemistry from the bulk dispensing cartridge 230 to the dispensing chamber 226. The controller 220 then signals a valve 234 to allow water from a water supply 236 into the dispensing chamber 226 to effect a flushing. The flushing of the dispensing chamber 226 may also act to flush the treating chemistry meter 232, which fluidly couples the dispensing chamber 226. Then, both the water and the treating chemistry travel through the suction pipe and the dispensing line 228, and into the treating chamber 216.

The multiple dispensing chambers 226 are similar to the multiple dispensing chambers 106, 108, 110 illustrated in FIGS. 2-5 except that the dispensing chambers 226 are spaced apart within the cabinet and are not in a common drawer. It should be noted that any of the single dose dispensing chambers 226 may have bulk dispensing functionality added to it as the bulk dispensing cartridge 230 may be configured to fit in any of the dispensing chambers 226. A treating chemistry meter 232 may already be in place or a treating chemistry meter may be a part of the bulk dispensing cartridge 230.

While the invention may have been specifically described in connection with certain specific embodiments thereof, it is to be understood that this is by way of illustration and not of limitation, and the scope of the appended claims should be construed as broadly as the prior art will permit.

What is claimed is:

1. A household cleaning appliance configured to execute a cleaning cycle on an article, comprising:

a cabinet defining an interior;

a rotatable drum located within the interior and defining a treating chamber for receiving an article for treating and wherein a rotational axis of the drum is vertical; and a dispensing system, comprising:

a non-bulk dispensing system including a housing that is fluidly coupled to the treating chamber;

a drawer storing multiple doses of a liquid treating chemistry, where the drawer is configured to be slideably moveable between an opened position and a closed position, where the drawer is within the cabinet; and a treating chemistry meter operable to couple the drawer to the housing of the non-bulk dispensing system when the drawer is in the closed position to control dosing of the liquid treating chemistry from the drawer to the housing of the non-bulk dispensing system such that the non-bulk dispensing system is provided with functionality of a bulk dispensing system.

2. The household cleaning appliance according to claim 1, further comprising a controller configured to implement the cleaning cycle and operably coupled to the treating chemistry meter to control dosing of the liquid treating chemistry to the non-bulk dispensing system.

3. The household cleaning appliance according to claim 2, further comprising a user interface electrically coupled with the controller and enabling a user to input commands to the controller.

4. The household cleaning appliance according to claim 3 wherein the controller is configured to receive at least one cleaning cycle, cycle parameter, or cycle option from the user interface and implement the at least one cleaning cycle, cycle parameter, or cycle option.

5. The household cleaning appliance according to claim 1 wherein the drawer further comprises a bulk dispensing cartridge that defines an interior treating chemistry chamber accessible through an opening configured to be selectively closed by a closing element that is operable between an opened and closed position through which the interior treating chemistry chamber can be filled when the closing element is in the opened position.

6. The household cleaning appliance according to claim 5 wherein the bulk dispensing cartridge is received within the drawer.

7. The household cleaning appliance according to claim 1 wherein the treating chemistry meter is configured to dispense multiple doses of liquid treating chemistry during the cleaning cycle.

8. The household cleaning appliance according to claim 1 wherein the treating chemistry meter comprises a pump.

9. The household cleaning appliance according to claim 1 wherein the treating chemistry meter is mounted to the cabinet.

10. The household cleaning appliance according to claim 9, further comprising a fluid coupling configured to fluidly couple the multiple doses of the liquid treating chemistry stored in the drawer to the treating chemistry meter.

11. The household cleaning appliance according to claim 10, further comprising a second fluid coupling configured to fluidly couple the treating chemistry meter to the non-bulk dispensing system.

12. The household cleaning appliance according to claim 11, further comprising a water supply selectively fluidly coupled to the non-bulk dispensing system to dispense the dosed liquid treating chemistry into the treating chamber.

13. The household cleaning appliance according to claim 1, further comprising a water supply selectively fluidly coupled to the non-bulk dispensing system to dispense the dosed liquid treating chemistry into the treating chamber.

14. The household cleaning appliance according to claim 1 wherein the non-bulk dispensing system comprises a chamber with a siphon or outlet fluidly coupled to the treating chamber.

15. In the household cleaning appliance according to claim 1, a method comprising:

adding bulk dispensing functionality to the non-bulk dispensing system by including the drawer, storing multiple doses of the liquid treating chemistry, within the cabinet of the household cleaning appliance wherein the drawer is configured to be slideably moveable between the opened position and the closed position, where the drawer is within the cabinet of the household cleaning appliance;

wherein when the drawer is in the closed position the treating chemistry meter operably couples the drawer to the housing of the non-bulk dispensing system when the drawer is in the closed position to control dosing of the liquid treating chemistry from the drawer to the housing of the non-bulk dispensing system such that the non-bulk dispelling system is provided with functionality of the bulk dispensing system.

16. The method according to claim 15, further comprising metering the liquid treating chemistry from the drawer to the housing.

17. The method according to claim 16, further comprising flushing the housing to dispense the metered liquid treating chemistry into the treating chamber.

18. The method according to claim 15 wherein the adding bulk dispensing functionality further comprises metering the liquid treating chemistry from the drawer to the non-bulk dispensing system.

19. The method according to claim 18, further comprising flushing the non-bulk dispensing system to dispense the metered liquid treating chemistry into the treating chamber.

* * * * *